United States Patent [19]

Morse

[11] Patent Number: 4,854,586

[45] Date of Patent: Aug. 8, 1989

[54] MODIFIED CRIBBAGE GAME UTILIZING CARDS AND DICE

[76] Inventor: Vicki M. Morse, P.O. Box 135, St. Albans, Me. 04971

[21] Appl. No.: 124,684

[22] Filed: Nov. 24, 1987

[51] Int. Cl.[4] ..... A63F 3/00

[52] U.S. Cl. ..... 273/249; 273/285

[58] Field of Search ..... 273/249, 285, 246, 287

[56] References Cited

U.S. PATENT DOCUMENTS

| | | | |
|---|---|---|---|
| 1,628,073 | 5/1927 | Sousa | 273/246 |
| 2,012,140 | 8/1935 | Popper | 273/285 |
| 2,415,073 | 2/1947 | Buffmire | 273/243 |
| 3,963,243 | 6/1976 | Contento | 273/246 |
| 4,264,076 | 4/1981 | Duncan | 273/246 |
| 4,323,240 | 4/1982 | Brady | 273/249 |

FOREIGN PATENT DOCUMENTS

| | | | |
|---|---|---|---|
| 2055299 | 3/1981 | United Kingdom | 273/287 |
| 2089220 | 6/1982 | United Kingdom | 273/246 |

OTHER PUBLICATIONS

Cribbage, "The Way to Play" by the Diagram Group, Paddington Press Ltd., 1976, pp. 112–113.

*Primary Examiner*—Edward M. Coven
*Assistant Examiner*—Benjamin Layno
*Attorney, Agent, or Firm*—W. G. Fasse; D. H. Kanes, Jr.

[57] ABSTRACT

A game relating to cribbage having a playing board with a number of tracks along each of its edges. The tracks surround a card storage area, a dice storage area, a so-called "kitty" or bank area and an area for holding the game bits or pegs located in a central zone of the board. Each track is divided into a plurality of sections and each track section is divided into a number of groups of action locations, for example, in the form of holes for removably inserting a game bit. Different characteristics expressed, for example by different colors, are allocated to each hole for randomly influencing the progress that a player can make along his or her track from start to finish as determined by the cards of his hand and by at least one die.

17 Claims, 3 Drawing Sheets

FIG. 6
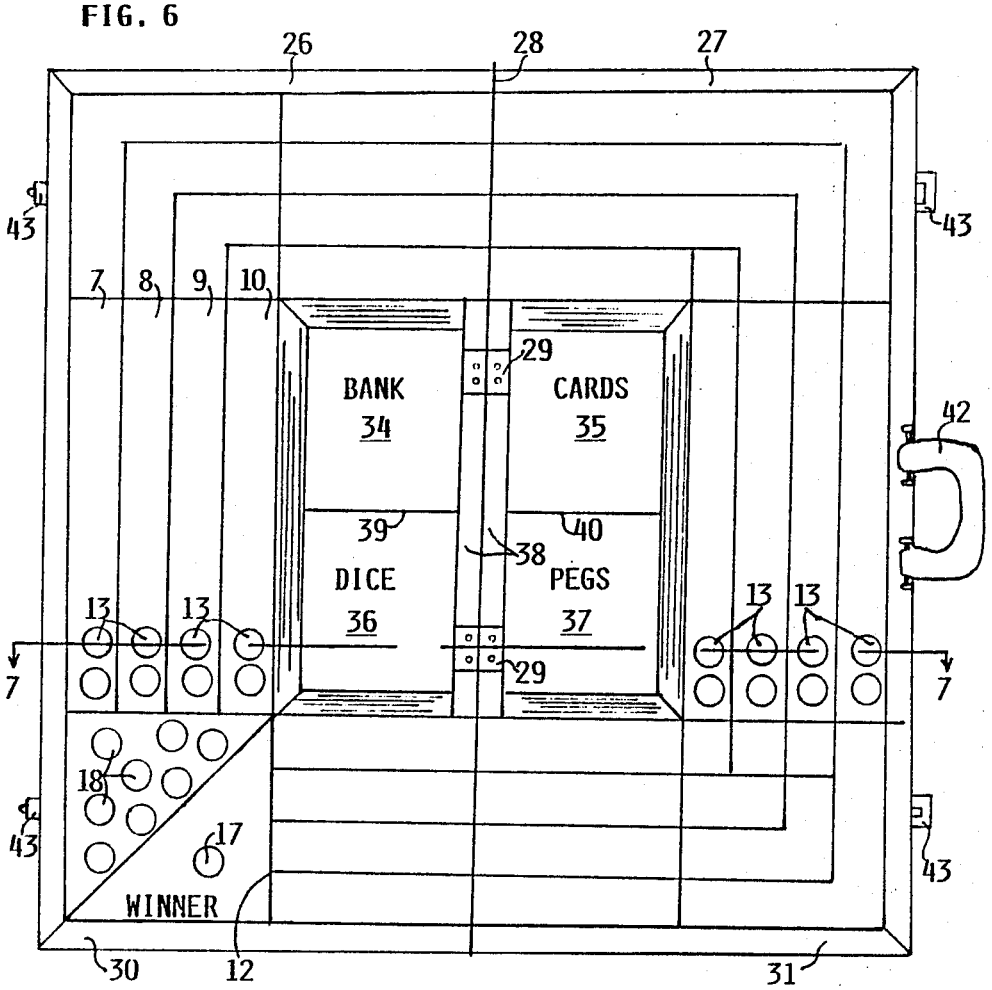
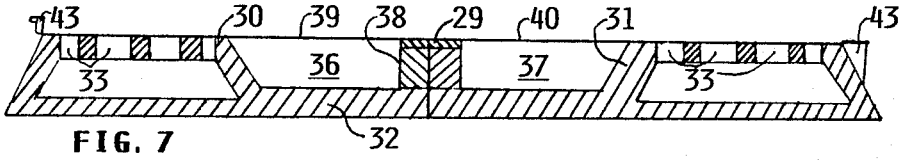
FIG. 7
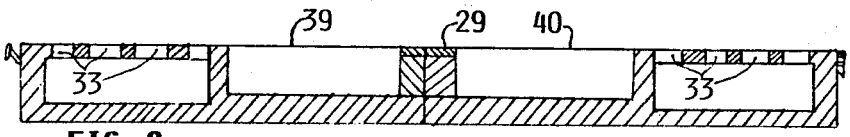
FIG. 8

MODIFIED CRIBBAGE GAME UTILIZING CARDS AND DICE

FIELD OF THE INVENTION

The invention relates to a combination card and die game which can be played by at least two players and which may also be played by three or four players.

DESCRIPTION OF THE PRIOR ART

U.S. Pat. No. 1,628,073 (Sousa) discloses a horse racing game in which four oval tracks merge into a single track at each end of the oval track. When one of the players happens to occupy the single track, he blocks the advance of all the other players. Three dice with different designations must be thrown simultaneously to determine the advance of the players along the track.

U S. Pat. No. 3,463,496 (Weinstein, et al.) discloses a racing game in which the advance of the players along the tracks is determined by red, white and green dice, as well as a starter die and further by racing luck cards and by whip cards. The game is intended to resemble an actual horse race as closely as possible. However, other races can also be played, such as car races or the like. The game also includes so-called photo-finish cards to determine who crossed the finish line first. However, regular playing cards are not used by Weinstein, et al.

U.S. Pat. No. 3,951,412 (Adams) discloses a horse racing board game in which the race track is printed on one side of one section of the game, while a maze is mounted on the other section of the game.

Conventional dice are used to introduce a chance element into the game. A maze introduces another chance element.

U.S. Pat. No. 3,963,243 (Contento) combines a race horse board game with a wheel of fortune and additionally employs dice with numbers and a choice die.

U.S. Pat. No. 4,062,545 (Witney) discloses a downhill ski racing game combining a track with chance cards and mishap cards.

U.S. Pat. No. 4,082,289 (Merritt) discloses a horse racing game employing different kinds of dice, odd chips, player chips, as well as position cards.

U.S. Pat. No. 4,264,076 (Duncan) discloses a board racing game in which primarily car races can be simulated. The lanes have different speed characteristics and one lane is the fastest.

U.S. Design Pat. No. 101,48 (Cukor) discloses the ornamental design of a game board, apparently intended for a horse racing game.

British Patent No. 657,018 (Cambray, et al.) discloses a speedway racing board in which chance cards determine the types of moves the players can make along the track. Standard playing cards cannot be used in this speedway racing game.

OBJECTS OF THE INVENTION

In view of the foregoing it is the aim of the invention to achieve the following objects singly or in combination:

to improve the conventional game of cribbage in such a way that it becomes more challenging;

to provide a game which can be played by two, three, or four players, and which is subject to a plurality of chance elements or factors;

to combine a simple game board with scorekeeping features; and to use conventional playing cards and conventional dice for the purpose of simplifying the combination of the entire game.

SUMMARY OF THE INVENTION

A card and die game according to the invention is characterized by a game board having a central zone and margin zones, preferably raised margin zones which surround a central zone. The game board is preferably square and carries a number of parallel tracks along the margin zones. First means, e.g. a line, designate a starting gate at the beginning of each track. Second means such as a further line designate a finish line at the end of each track. Each track has a plurality of action locations arranged in a row, preferably in the form of holes. Third means define different characteristics for the action locations or at least groups of action locations. A deck of conventional playing cards is used for introducing first chance elements into playing the game and conventional die means are used for introducing second chance elements into the game. At least two game bits are provided, preferably in the form of pegs.

The different characteristics of the action locations are distributed in random fashion along each of the tracks in such a way that each track provides the same chances for a player. The playing cards and the dice and the different characteristics of the action locations along the tracks are used in combination for determining the advance or retreat of the game bits along each track. The action locations, or rather their different characteristics, may or may not introduce a third chance element.

Compared to the prior art, including the game of cribbage, the invention has the following advantages. The present invention encourages a player into trying to control his or her point count of the cards, for example, to avoid reaching an adverse action location. The present game is more challenging than a conventional cribbage game because of chances introduced by the action locations by the playing cards and by the die or dice. This game also encourages competition amongst the players. The present game increases the chances of advancing or retreating by points other than card points, namely, points determined by the dice. The arrangement of the four track sections allows an easy accessibility of the game bits when advancing. The set-up of the four track sections also allows a person to see at a glance who is in the lead position.

BRIEF DESCRIPTION OF THE DRAWINGS

In order that the invention may be clearly understood, it will now be described, by way of example, with reference to the accompanying drawings, wherein:

FIG. 6 is a top plan view of a modified embodiment of the game board according to the invention which is foldable to form a briefcase type of game board;

FIG. 7 is a sectional view along section line 7—7 in FIG. 6; and

FIG. 8 is a sectional view similar to that of FIG. 7, but showing a modified construction of the raised margin zones.

DETAILED DESCRIPTION OF PREFERRED EXAMPLE EMBODIMENTS AND OF THE BEST MODE OF THE INVENTION

Figure 1:
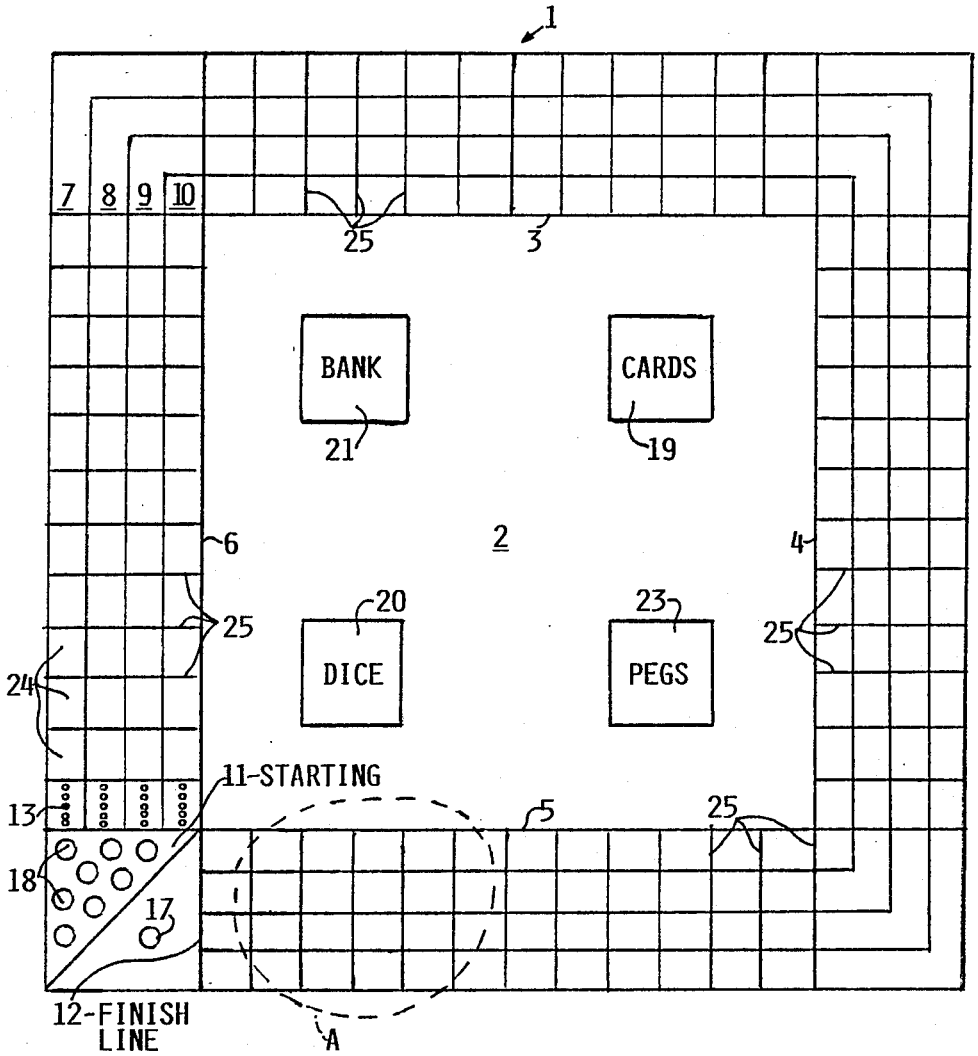
FIG. 1 illustrates a top plan view of a game board according to the invention.

FIG. 1 shows one embodiment of a game board 1 according to the invention. The game board has a central zone 2 and four margin zones 3, 4, 5, and 6 surrounding the central zone. Each margin zone carries, for example, parallel tracks or track sections 7, 8, 9, and 10. A first line 11 designates a starting gate at the beginning of each track. A second line 12 designates a finish line at the end of each track. Each full track is divided into four track sections corresponding approximately to the margin zones 3, 4, 5, and 6. Each track is further divided into a plurality of action locations 13 arranged in a row along each track. Only five action locations 13 are shown next to the starting line 11. However, a total of sixty action locations are provided along each track section and a total of 240 action locations are provided along the entire length of each track 7, 8, 9, and 10. The action locations 13 have different characteristics. These characteristics may be defined by different colors as will be explained below with reference to FIG. 2. However, symbols other than color may be used to designate the different characteristics of the action locations 13. As shown in FIG. 3, a deck of conventional playing cards 14 is part of the present game for introducing first chance elements into playing the game.

Figure 4:
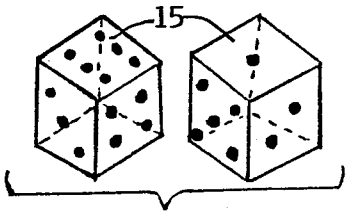
FIG. 4 illustrates a set of conventional dice.
Figure 5:
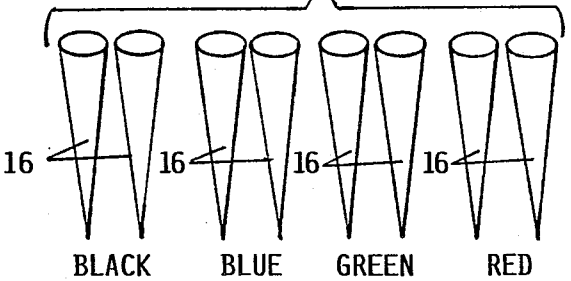
FIG. 5 illustrates four pairs of game bits as used in the present invention.

As shown in FIG. 4, a pair of conventional dice 15 is used for introducing second chance elements into playing the game. FIG. 5 shows four pairs of game bits, for example, in the form of differently colored pegs that are used for playing the game. At least two game bits of different colors will be used if two players participate in playing the game and each would have one peg 16. However, preferably, each player will have a pair of pegs of the same color. The different characteristics of the action locations 13 are distributed along each track in a random pattern which is the same for each track so that all players have the same chances as far as the track is concerned. The deck of playing cards, the conventional dice, and the different characteristics of the action locations are used in combination for determining the advance or retreat of the game bits along each track. A complete set of rules for playing the game will be explained in more detail below.

Referring further to FIG. 1, a marker 17 designates the winning location, preferably next to the finish line 12. Only one marker 17 is provided, since there can be only one winner. A plurality of starting locations 18 is provided preferably next to the starting line 11. Where the starting locations 18 are holes, the pegs 16 may be inserted into these holes. The starting locations are merely rings or spots or the like, the pegs may still be placed into these locations with their large ends down.

The central zone 2 has a first storage area 19 for holding the deck of cards 14. A second storage area 20 holds the dice 15. A third storage area 21 is designated as a bank or kitty for holding an extra playing hand. A fourth storage area 23 may hold the game bits or pegs 16 when the game is not in use.

For enabling two players to play the game, at least two parallel tracks will be provided with two starting locations or symbols 18 and each player will require at least one game bit. The finish line 12 may be labelled as such and the action locations 13 will be divided into first, second, third, and fourth pluralities of action locations distinguished from each other by four different colors to define the different characteristics of each action location along each of the at least two, three, or four tracks.

Figure 2:
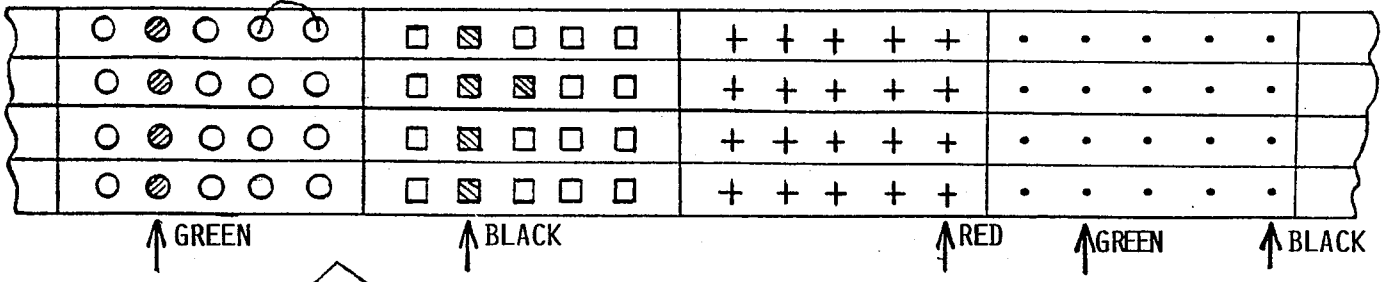
FIG. 2 shows on an enlarged scale, compared to FIG. 1, a track portion encircled by a dashed line A in FIG. 1.
Figure 3:
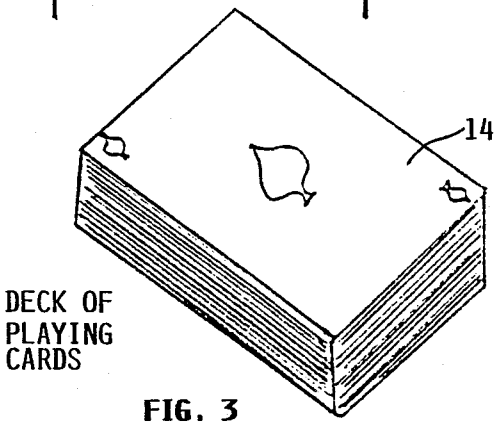
FIG. 3 shows a conventional deck of cards.

Referring to FIG. 2, different symbols may be used for designating the action locations, for example, in the form of circles, squares, crosses, dots, and the like. Normal action locations may be white. Neither a penalty nor a bonus characterizes these white action locations. Green, red, and black action locations will have different characteristics as will be explained in more detail below.

Preferably, the board 1 has a square configuration and the starting gate or line 11, as well as the finish line 12 are located next to the same corner as shown in the lower-left corner of FIG. 1.

As mentioned, the action locations 13 may be round holes so that the pegs 16 fit into these holes, provided that the margin zones are raised as shown in FIGS. 6, 7, and 8. The pegs 16 fit into these action holes and the pegs are preferably provided in pairs and each pair having a different color. However, the cross-section of the holes and pegs does not need to be round. Other configurations are just as suitable.

As shown in FIGS. 1, 2, and 6, there are preferably four parallel tracks and each track has four sections along the respective sides of a preferably square board 1. Each track section is divided into twelve groups 24 by division lines 25. Each group contains five action locations, whereby each track has a total of 240 action locations 13, plus at least one starting location 18 for each track 7, 8, 9, and 10. As mentioned, each of the game bits, such as pegs, is marked for distinguishing the game bits of one player from the game bits of another player, for example by different colors.

Referring to FIGS. 6 and 7, the modification of the present game board comprises two sections 26 and 27 divided along a hinging axis 28, but interconnected by hinges 29 to form an attache case type of game board that may be opened for playing the game and closed again for storing. The same reference numbers as in FIG. 1 are used in FIG. 5 for designating the same elements. Only a few action locations are shown for simplicity's sake.

The margin zones 30 of the board section 26 and the margin zone 31 of the board section 27 are raised relative to the bottom 32 of the board as best seen in FIG. 7. Thus, hollow spaces are provided below the top portions of the margin zones so that the pegs 16 may be inserted into holes 33 forming the action locations 13. The margin zones 30 and 31 surround the central zone so as to form recesses 34, 35, 36, and 37, whereby hinging walls 38 and dividing walls 39 and 40 cooperate with the raised margin zones in providing the just mentioned recesses 34, 35, 36, and 37 for holding the bank, the deck of cards, the dice, and the pegs respectively.

One or two handles 42 may be provided for carrying the game board as is conventional. Similarly the locking means 43 are conventional.

The hinging walls 38 and the divider walls 39 and 40 are of the same height as the raised margin zones 30 and 31 as best seen in FIG. 7 so that in the closed condition the recesses 36 and 37, as well as 34 and 35, will be completely separated from each other. The hinging walls 38 are two parallel walls which divide the board into mirror-symmetrical sections 26 and 27.

In FIGS. 6 and 7, the raised margin zones have slanted walls. However, the walls forming the raised margin zones can also be vertical as shown in FIG. 8. Otherwise the construction of the embodiment of FIG. 8 is the same as that of FIGS. 6 and 7. The significance of the different characteristics of the action locations is as follows. A white or similarly designated action location involves neither a bonus nor a penalty. Thus, landing with your game bit on a white location does not result in a further advance nor in a retreat. Landing on a red or similarly designated action location provides the bonus enabling the player to roll one or two dice once to advance that number of action locations. If a player lands on a black or similarly designated action location he must roll both dice and retreat by the respective number of steps or action locations as indicated by the dice. The green or similarly designated action locations are so-called "kitty" or "bank" locations meaning that the player whose game bit lands on a green action location gets the content of the bank. However, this happens only when counting the total number of points in the players hand. If two players land on a green action location, each player rolls a die and the lower count takes the bank. If no player lands on a green action location when counting the points, the bank is lost for that hand.

If a player has four of a kind, including the bank hand, that player rolls one die and advances that number of steps. Each action location is one step or point. If the "right jack" is cut up, the dealer is permitted to roll the dice once and advance by the respective number of points or steps. The "right jack" in hand or in the bank is permitted to roll one die once and to advance accordingly.

The following point count applies to playing this game. A card that is cut up and turned face up on the deck is everyone's card during the count-up, and can be combined with any players hand. Each combination of cards that adds up to 15 is worth two points. Two matching cards, for example two queens, is worth two points. Three matching cards, for example, three fours, is worth six points. Four matching cards, for example four eights, is worth twelve points, plus a roll of one die. A hand is called a "run" if three or more cards are in sequence and is worth one point for each card in sequence. A "run" with a duplicated sequence of cards, such as 2, 3, 3, 4, is worth six points, plus two points for the duplicated sequence, (i.e. 3, 3), adding up to a total of eight points for this hand. This duplication of sequence is called a "double run". A "double run" of four cards scores ten points. A run of three where one card is repeated three times is called a "triple run" and scores fifteen points. A "flush" is a hand with four cards of the same suit, and is worth four points. If the card turned up on the deck is the same suit, the point count is worth five points. In order to obtain a "flush" when counting the "kitty" or "bank" hand, the card turned up on the deck must be used and the point count must be five. A jack in the hand or "kitty" that matches the suit of the card on deck gets a roll of one die to advance that number of points. If a person has a "zero" or "null" hand, he has to roll one die to go back that number of this also happens when a zero or null hand occurs when points, this also happens when a zero or null hand occurs when counting the kitty hand. As each player plays his card around the board, the face value of each card is counted as follows: ace equals one point, two to ten is face value, jacks, queens, and kings are counted as ten points each. The hand is played out when a player reaches on or closest to thirty-one. The play continues in a clockwise manner around the board. In counting the face value of each card when playing out a hand, a player tries to make a count of fifteen, for which he scores two points, or a count of thirty-one, for which he scores two points. The person counting closest to thirty-one, without going over thirty-one, scores one point. In addition, all of the preceding point counts may be reached by a player when playing out a hand. When a player makes a point count when playing out a hand, he places his game bit ahead that number of action locations.

When two players are playing the game, each player is dealt six cards each. The player then chooses the hand he will hold and places two cards, face down, in the "kitty" or "bank" on the game board.

When three players are playing the game, each player is dealt five cards each. The dealer then deals one card face down in the spot designated kitty on the game board. The players then choose their hand and discard only one card from their hand to the kitty.

When four players are playing the game, each player is dealt five cards each. The players choose their hand, and discard only one card each from their hand to the kitty.

The aim of the game is to be the first player to go from the starting line 11 to the finish line 12 by scoring or pegging 241 points. Each player picks preferably two pegs for moving around the board. A roll of a single die by each player determines who may start and who is the dealer, the low score of the die wins. The play rotates clockwise around the board.

This game can be played by two, three, or four players. The game begins by dealing out cards from the conventional deck of fifty-two playing cards 14. Then, each player inspects his hand to determine which cards to place into the "kitty" and which cards to keep, then the person to the right or left of the dealer cuts the deck and the dealer flips the "cut" card face up on the remaining playing cards in the deck left on the area 19 designated "cards" on the game board. The dice are also left on the designated area 20 marked "dice" on the game board. The hand is then played out from player to player clockwise around the board with the first player laying a card face up on the table and the next player picking up the point count from there. As each point is counted and a hand is completed around the board, the player who wins a point count, pegs or counts the corresponding number of action locations in his lane on the track. Each player begins pegging or counting at the starting gate and goes forward the number of holes he has corresponding to the number of the point count of the cards.

If a player lands in a "red" action location he throws one or two dice and goes forward according to the number of the total point count shown by both dice. If a player lands in a "black" action location he must throw both dice and go back according to the sum of the point count shown by both dice. The player who lands in a "green" action location after everyone has counted in turn, adding up the total number of points in each hand after all the hands have been played out, that player gets the "kitty" or "bank" of that hand. This only happens when counting the total number of points in each individual player's hand, including any roll of the die, after the hands have been played out. If two persons land exactly on a green action location, each player throws one die and the low die takes the "kitty" hand. If no one lands on a green action location, then the kitty is lost for that hand. Each player counts his hand only after the preceding player has counted his hand. The player (if any) who lands on a green action location and gets the kitty hand, adds up his point count of the kitty hand only after all players have counted their hand, and then advances by the corresponding number of action locations along his track. The play continues in this fashion until a player reaches and goes past the finish line 12 first.

Although the invention has been described with reference to specific example embodiments, it will be appreciated, that it is intended to cover all modifications and equivalents within the scope of the appended claims.

What I claim is:

1. A combination card and die game for playing an improved game of cribbage, comprising a game board having a central zone and margin zones surrounding said central zone, a number of parallel tracks in each of said margin zones, first means designating a starting line at a beginning of each of said tracks, second means designating a finish line at an end of said tracks, a plurality of action locations arranged in a row along each track for keeping a score for each player along his or her track, third means defining different characteristics for at least some of said action locations, a deck of conventional playing cards comprising four suits of cards with diamonds, spades, clubs and hearts wherein an ace equals one point, two to ten equal face value, and jacks, queens, and kings are equal to ten points each for introducing first chance elements into playing the game, conventional die means for introducing second chance elements into playing the game, and at least two game bits for each player, said different characteristics of said action locations having a random distribution along each track for introducing third chance elements into playing the game, said random distribution being the same for each track so that each track is the equivalent of any of the other tracks, said deck of playing cards, said conventional die means, and said different characteristics of said action locations as defined by said third means being used in combination for determining the advance or retreat of said game bits along their respective track of each player, wherein any one of the characteristics of an action location in combination with a die score or a specified card combination or card in combination with a die score provide additional score points.

2. The game of claim 1, wherein said number of parallel tracks is four, said four tracks being all located in said margin zones, wherein said central zone comprises a first storage area for said deck of playing cards, a second storage area for said die means, a third area designating a kitty or bank for holding playing cards deposited in the ditty or bank by the players, and a fourth storage area for holding said game bits when not in use.

3. The game of claim 1, wherein said number of parallel tracks comprises two tracks, wherein said first means comprise at least two symbols designating said starting line for said at least two game bits, wherein said second means comprise a finish line label, wherein said action locations comprise along each track first, second, third, and fourth pluralities of action locations, said third means comprising a first, a second, a third, and a fourth color for defining four different characteristics for said respective first, second, third, and fourth pluralities of action locations along each track.

4. The game of claim 3, wherein said four different colors are black, blue, green, and red for defining said different characteristics of said first, second, third, and fourth pluralities of action locations.

5. The game of claim 1, wherein said game board is a square, wherein said starting gate is located in a corner of said square, and wherein said finish line is located in said same corner as said starting gate.

6. The game of claim 1, wherein said action locations are action holes and wherein said game bits are pegs removably fitting into said action holes, said pegs comprising at least two pegs, each peg having a different color.

7. The game of claim 6, wherein said pegs comprise at least two pairs of pegs, each pair of pegs having a different color.

8. The game of claim 1, wherein said number of parallel tracks is four, wherein each track has four sections and sixty action locations in each track section, and twelve division lines across each track section for dividing said action locations along each track section into twelve groups of five action locations in each group, whereby each track has a total of two-hundred-forty action locations plus at least one starting location for each track.

9. The game of claim 1, wherein said game bits are marked for distinguishing the game bit of one player from the game bit of another player.

10. The game of claim 9, wherein said game bits comprise at least two pairs of game bits, each of said at least two pairs of game bits having a different color.

11. The game of claim 1, wherein said margin zones of said game board are raised relative to said central zone of said game board so that said central zone forms a recess surrounded by said raised margin zones, said parallel tracks being located on said raised margin zones.

12. The game of claim 11, wherein said action locations in each track are holes in said raised margin zones, and wherein said game bits are pegs removably fitting into said action holes in said raised margin zones.

13. The game of claim 11, further comprising two central raised walls having a height above said game board corresponding to a height of said raised margin zones, said central raised walls extending in parallel to each other and dividing said game board into two equal board sections, and hinge means interconnecting said two parallel central walls for forming an enclosure when said two equal board sections are closed so that said raised margin zones of one board section face the raised margin zone of the other board section.

14. The game of claim 13, further comprising handle means secured to at least one of said board sections for carrying said game board in its closed condition.

15. The game of claim 13, further comprising locking means for securing said board sections to each other when said board sections are in a closed condition.

16. The game of claim 1, wherein said board is a square, and wherein each of said tracks has four track sections extending along said margin zones of said square.

17. The game of claim 1, further comprising a marker designating a winning location next to said finish line.

* * * * *

UNITED STATES PATENT AND TRADEMARK OFFICE

CERTIFICATE OF CORRECTION

PATENT NO. : 4,854,586

DATED : August 8, 1989

INVENTOR(S) : Vicki M. Morse

It is certified that error appears in the above-identified patent and that said Letters Patent is hereby corrected as shown below:

In the Specification:

Column 1, line 51, replace "101,48" by --101,487--.

Column 5, line 64, after "of" insert --points,--;
line 65, delete "points,--;
line 66, delete the entire line.

In the Claims:

Claim 1, (Column 7, line 7 of claim 1), after "end" insert --of each--.

Claim 2, (Column 7 , line 7 of claim 2), replace "ditty" by --kitty--.

Signed and Sealed this

Fifteenth Day of January, 1991

*Attest:*

HARRY F. MANBECK, JR.

*Attesting Officer*

*Commissioner of Patents and Trademarks*